United States Patent [19]

Pert et al.

[11] 4,365,629

[45] Dec. 28, 1982

[54] PLATELET FREEZING BAG

[75] Inventors: James H. Pert, Glenmont, N.Y.; Peter Unger, Stockholm, Sweden; Hervie L. Harris, East Greenbush; James C. Pert, Glenmont, both of N.Y.

[73] Assignee: Hedbergska Stiftelsen, Stockholm, Sweden

[21] Appl. No.: 197,898

[22] Filed: Oct. 17, 1980

Related U.S. Application Data

[63] Continuation of Ser. No. 42,797, May 29, 1979, abandoned.

[51] Int. Cl.[3] ..... A61M 5/00

[52] U.S. Cl. ..... 128/214 D; 128/272; 128/DIG. 24

[58] Field of Search ..... 128/214 D, 274, 214 R, 128/272, 272.2, DIG. 24; 150/1

[56] References Cited

U.S. PATENT DOCUMENTS

| | | | |
|---|---|---|---|
| 2,838,046 | 6/1958 | Butler | 128/214 D |
| 3,211,144 | 10/1965 | Nehring | 128/214 D |
| 4,084,606 | 4/1978 | Mittleman | 128/274 |
| 4,183,434 | 1/1980 | Watt | 128/214 D |
| 4,198,972 | 4/1980 | Herb | 128/214 D |

FOREIGN PATENT DOCUMENTS

| | | | |
|---|---|---|---|
| 1282046 | 12/1961 | France | 128/214 D |
| 7707581 | 1/1978 | Netherlands | 128/214 D |

*Primary Examiner*—Richard J. Apley
*Assistant Examiner*—T. J. Wallen
*Attorney, Agent, or Firm*—Cooper, Dunham, Clark, Griffin & Moran

[57] ABSTRACT

A platelet freezing bag made of pliable plastic material has two needle ports designed to accept a syringe needle for transferring platelet concentrate and diluent plasma into the bag and a large draining port. The ports are protected and closed by pull-apart seals. The draining port is separated from the platelet receiving compartment by a push-apart seal which can be opened by exerting gentle pressure on the contents of the bag.

1 Claim, 1 Drawing Figure

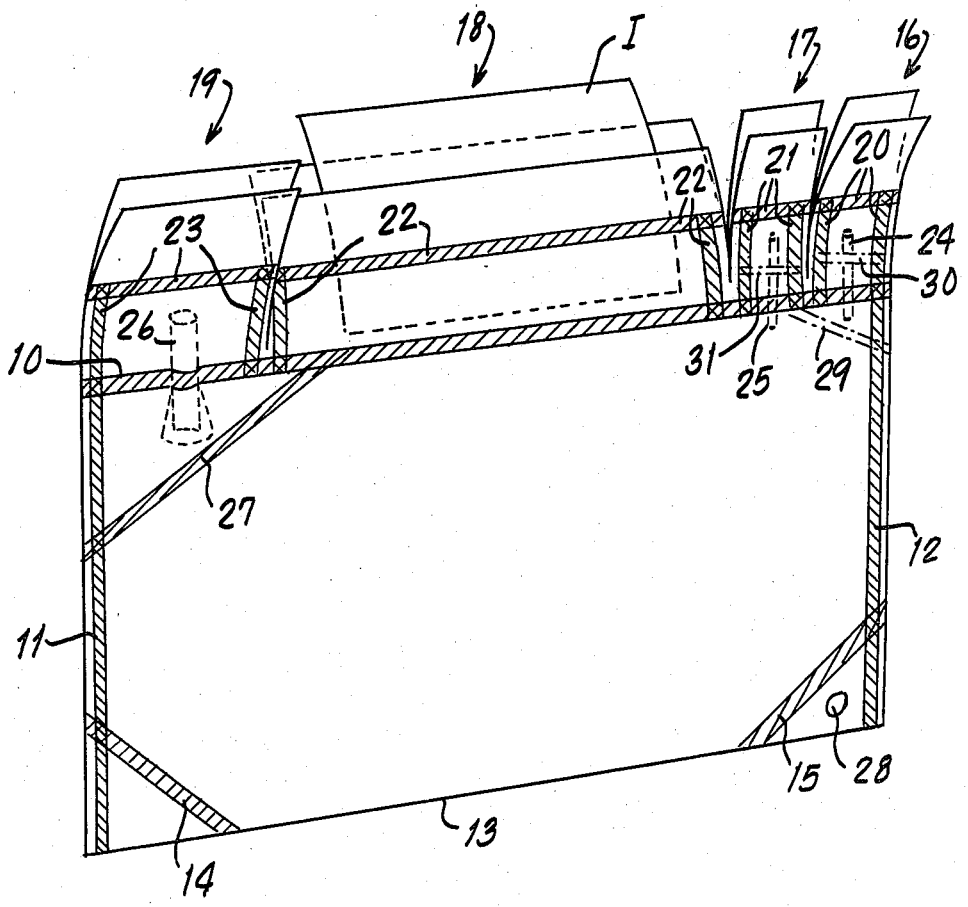
18
I
17
16
19
21
20
22
22
23
24
30
26
10
31
25
29
27
12
11
15
28
13
14

PLATELET FREEZING BAG

This is a continuation of application Ser. No. 42,797 filed May 29, 1979, now abandoned.

This invention relates to a cryopreservation or freezing bag, particularly for cryopreservation of platelet concentrates or other cellular suspensions.

The general object of the invention is to provide an improved freezing bag. A more specific object is to provide an improved platelet freezing bag which effectively prevents platelets or contaminant red cells from entering the ports and adversely affecting the function of the remaining platelets by causing post-thaw platelet clumping.

BRIEF DESCRIPTION OF THE DRAWING

FIG. 1 illustrates a platelet freezing bag in accordance with the present invention.

DETAILED DESCRIPTION OF THE INVENTION

The platelet freezing bag is made by folding a rectangular sheet of transparent plastic film e.g. polyethylene film, upon itself and sealing the two opposed layers together with plastic port tubes inserted between them as described in greater detail hereinafter.

The opposed layers are permanently heat sealed together along a number of permanent, i.e. unbreakable seals, namely, a top seal 10 extending across the width of the bag, a pair of lateral seals 11,12 extending between the top seal 10 and the fold 13, and a pair of corner seals 14,15 extending obliquely between the fold 13 and the lateral seals 11,12. A closed compartment for receiving a platelet concentrate and diluent plasma is defined by the two plastic layers and the permanent seals.

In the region above the permanent top seal 10 the two plastic layers are cut along lines parallel to the permanent lateral seals 11,12 to form four tabs 16,17,18,19. In each tab the two layers are sealed together along hermetic pull-apart seals (peel seals) 20,21,22,23; these seals can be opened by pulling the two layers of the tabs apart.

In the tab 16 there is a first needle port 24 in the form of a polyethylene tube designed to accept an 18-gauge syringe needle with a close fit. A similar second needle port 25 is provided in the tab 17. The needle ports 24,25 are positioned between the two plastic layers and extend through (and are held in position by) the permanent top seal 10 to communicate at one end with the platelet receiving compartment and at the other end with the small pouches defined by the pull-apart seals 20,21 and the adjoining section of the permanent top seal 10.

In the tab 18 a label I for identification and/or other data is positioned between and sealed to the plastic layers. If desired, the seal 22 of the tab 18 may be a permanent seal.

A draining port 26 in the form of a thin-walled polyethylene tube is positioned between the plastic layers of the tab 19. It is substantially wider than the tubes forming the needle ports and extends through (and is held in position by) the permanent top seal 10 to communicate at one end with the platelet receiving compartment and at the other end with the small pouch defined by the pull-apart seal 23 and the adjoining section of the permanent top seal 10. The section of the draining port 26 which is below the permanent top seal 10 is slitted longitudinally along two diametrically opposed lines to permit complete draining of the platelet receiving compartment.

Across the corner of the receiving compartment where the draining port 26 is provided there is a push-apart seal (burst seal) 27 joining the opposed plastic layers together.

This push-apart seal 27 extends diagonally between the top seal 10 and the lateral seal 11 and serves to prevent the contents of the platelet receiving compartment from contacting the drain port during normal handling of the freezing bag prior to transfusion. A gentle pressure on the contents of the bag is sufficient to cause it to burst open the push-apart seal 27 to allow draining of the bag through the drain port 26.

At the corner of the bag diagonally opposed to the draining port 26 a hole 28 is cut through the plastic layers within the area defined by the lateral seal 12, the fold 13 and the corner seal 15. During drainage the bag is suspended on a peg using the hole 28.

The improved freezing bag is used as follows.

After the first needle port 24 has been made accessible by opening the pull-apart seal 20 of the tab 16 the glycerolized platelet concentrate is transferred to the receiving compartment using a syringe the needle of which is inserted into the needle port 24. Before the needle is removed, the needle port is again sealed by a permanent seal using a hand heat sealer. The seal is placed either across the bag corner as shown at 29 (preferred) or across the tab 16 as shown at 30.

The bag is then transferred to a freezer and stored in a cryostorage.

After thawing the second needle port 25 is made accessible by opening the pull-apart seal 21 and diluent plasma is transferred into the receiving compartment using a syringe. Before the syringe needle is removed, a permanent seal is applied as shown at 31 to close the needle port 25.

The diluent plasma and the thawed platelet concentrate are mixed by gently manipulating the bag. An infusion stylet is inserted into the drain port 26. A gentle pressure is then exerted on the bag to open the push-apart seal 27, and finally the bag with the attached infusion stylet is suspended to cause the contents to flow towards the draining port. After completed drainage the bag is discarded.

New design features, namely the burst seal and the peal seal, are incorporated in the new platelet freezing bag and utilize the properties of specially processed Pharmachem plastic film (Pharmachem Corporation, Bethleham, Pennsylvania). The features simplify the operations associated with platelet freezing and reduce cost, but more importantly they provide a much improved product compared to that from other current freezing bags. When using the currently available UCAR* bags, even introducing air did not prevent platelets from entering the ports and being cooled at an improper rate; if even a small number of platelets or contaminant red cells are injured, they will adversely affect the function of the remaining platelets. With UCAR bags, it was usually necessary to centrifuge platelets with plasma an additional time to remove contaminating red cells. After freezing, red cells would lyse and irreversible post-thaw clumping of the platelets was a serious problem. With the new freezing bag considerable red cell contamination no longer results in irreversible post-thaw platelet clumping.

*Bel-Art, Pequannock, New Jersey

The new design features are as follows: There are 2needle parts on one side of the top. The first needle port is covered with a peal seal so that it may be pealed open and entered aseptically with a blunt or sharp needle, thus avoiding the cost of a separate injection site.

The volume of air in the bag, including no air, may be regulated easily. After injection, the needle tubing may be sealed off, or the seal may be placed diagonally across the corner of the bag, rounding off that corner. This allows better post-thaw mixing, and agitation during that step may be more gentle, avoiding any problems of trapping platelets in that corner, which might be subjected to undue osmotic shock.

The second needle port is used for post-thaw dilution and has the same advantages as the first needle port regarding peal seal convenience and cost. In addition, the plastic pouch made by the peal seal is very small so that if, during manipulations, pressure is placed on the contents of the bag, pressure also rapidly rises in the small pouch generally preventing the platelets from entering the pouch. If a small number do enter, they will be trapped in the bottom of the pouch and when the needle port is entered for post-thaw dilution, these trapped platelets will be excluded.

A large port is located at the opposite corner from the two needle ports; the function of this port is to accept either an injection site or infusion set. The wall of this port is relatively thick and extends below the seal and into the bag, protecting the thin plastic film of the bag from rupture when a stylet is placed in the large port. The portion of the large port within the bag is cut length wise so that when the bag is emptied, essentially all the platelets can drain through the sliced portion. If platelets were to enter this large port area during freezing they would be subjected to improper cooling rates and be injured. To prevent this, a diagonal burst seal is placed across the corner of the bag where the large port is located. The burst seal is opened after post-thaw dilution so that the platelets may drain from the large port. The diagonal burst seal also facilitates post-thaw dilution as described under the first needle port function.

The two bottom corners of the bag are also sealed diagonally but with a permanent seal; as with the other corners, these seals also facilitate post-thaw mixing with diluent.

As will be obvious to one skilled in the art, many modifications, variations, alterations and the like may be made in the practices of this invention without departing from the spirit and scope thereof as set forth in the claims which follow.

What is claimed is:

1. A freezing bag useful for platelet freezing comprising two pliable layers of polymeric material, said layers defining between them a sealed compartment for receiving platelets to be placed therein for freezing, two needle ports at one end of the sealed top edge of said compartment for introducing material into said compartment, a draining port positioned between said layers at the other end of the sealed top edge of said compartment, the lower end of said draining port extending into said compartment below the sealed top edge thereof being slit longitudinally along two diametrically opposed lines, said two layers of polymeric material being additionally sealed diagonally below said lower end of said draining port to prevent contact of the contents of said compartment with said draining port, the seal thusprovided being burstable, three sealed tabs, said tabs being adapted upon being pulled apart to uncover respectively said needle and said draining ports, said tabs consisting of portions of said pliable layers of polymeric material extending beyond the sealed top edge of said compartment where said needle ports are positioned, said compartment being sealed at the two bottom corners thereof with a diagonal seal to facilitate post-thaw mixing of platelets introduced into said compartment for freezing and a hole provided through said freezing bag at the corner thereof diagonally opposite from said draining port and positioned such that the corresponding bottom diagonal corner seal is located between said hole and the interior of said compartment.

* * * * *